United States Patent [19]

Siegla

[11] 4,249,488

[45] Feb. 10, 1981

[54] VALVE LIFT ADJUSTING DEVICE

[75] Inventor: Donald C. Siegla, Bloomfield Hills, Mich.

[73] Assignee: General Motors Corporation, Detroit, Mich.

[21] Appl. No.: 942,349

[22] Filed: Sep. 14, 1978

[51] Int. Cl.[3] ..... F01L 13/00; F02D 13/06

[52] U.S. Cl. ..... 123/90.16; 123/90.32; 123/90.43; 123/198 F

[58] Field of Search ..... 123/198 F, 90.15, 90.16, 123/90.32, 90.43, 90.39

[56] References Cited

FOREIGN PATENT DOCUMENTS 2621794 11/1976 Fed. Rep. of Germany ..... 123/198 F 2648799 5/1977 Fed. Rep. of Germany ..... 123/198 F

*Primary Examiner*—Ira S. Lazarus

*Attorney, Agent, or Firm*—R. L. Phillips

[57] ABSTRACT

In an internal combustion engine having a rocker arm operated intake valve, there is provided a valve lift adjusting device that adjusts the fulcrum of the rocker arm between a full-lift position producing full valve lift and a partial-lift position producing partial intake valve lift. The valve lift adjusting device includes a selector member which selectively serves as a lift stop determining the full-lift position of the fulcrum, and alternatively, permits the fulcrum to engage another lift stop to determine the partial-lift position.

2 Claims, 4 Drawing Figures

VALVE LIFT ADJUSTING DEVICE

This invention relates to a valve lift adjusting device and more particularly to a valve lift adjusting device for adjusting valve lift in an internal combustion engine.

In spark ignition internal combustion engines having cam operated intake and exhaust valves, the size of the intake valve and the camshaft timing used therewith is generally a compromise between the desire for high volumetric efficiency at high engine speeds for maximum power purposes on the one hand and smooth idle operation and good low speed efficiency on the other hand. For naturally aspirated engines, high volumetric efficiency requires large intake valves and large valve lifts with relatively large valve overlap between the intake valve closing and the exhaust valve opening events. In direct opposition, reduced intake valve size and valve lift is required to promote greater gas turbulence in the combustion chamber which in turn promotes higher burning velocities and thus higher indicated thermal efficiencies for smooth idle operation and good low speed efficiency. Furthermore, reduced valve overlap tends to reduce the amount of trapped exhaust gases in the combustion chamber, normally referred to as the combustion chamber residual fraction, which of itself improves the smoothness of engine operation at idle. In attempting to solve this conflict in engines having rocker arm actuated valves, various mechanisms have been proposed for varying the valve lift during engine operation by adjusting the rocker arms fulcrum; however, such mechanisms typically have either complex structure and/or require special manufacturing modifications to meet various specific valve lift requirements.

The valve lift adjusting device according to the present invention is a simple structure and in addition requires no special manufacturing modifications to meet various specific valve lift requirements in a rocker arm actuated valve arrangement. The present device includes a fulcrum member for the rocker arm which is movable between a full lift position where the rocker arm movement effects full valve lift and a partial-lift position where the working movement of the rocker arm is decreased to thereby effect a predetermined partial valve lift which may, for example, be one-half of full lift. A selector member, which is preferably operated by a solenoid but which may also be operated manually, selectively serves as a lift stop to determine the full-lift position of the fulcrum and, alternatively, permits the fulcrum to engage a second lift stop to determine the partial lift position all when the engine is running. The device is very versatile in that the thickness of the selector member determines the partial-lift position which is thus simply adjustable with selector members of various thicknesses to provide the exact partial valve lift desired in a particular engine application. With the present device installed in each intake valve mechanism of the engine and when the engine is operating at low speeds the selector members are all operated to effect the device's partial-lift condition to reduce the intake valve lift and either decrease or even eliminate valve overlap. Alternatively, at high engine speeds the selector members are all operated to effect the device's full-lift condition to increase the intake valve lift and valve overlap to that of a normal high volumetric efficiency engine. The net effect is increased power output of the engine at high speeds and improved thermal efficiency and idle smoothness at low engine speeds.

An object of the present invention is to provide a new and improved valve lift adjusting device.

Another object is to provide a new and improved valve lift adjusting device for adjusting the valve lift of an intake valve in an internal combustion engine between full-lift at high engine speeds and decreased or partial valve lift at low engine speeds.

Another object is to provide in a valve lift adjusting device for adjusting the fulcrum of a rocker arm to effect change in valve lift, a selector member which selectively serves as both a lift stop to condition the fulcrum in a full valve lift producing position and alternatively permits the fulcrum to engage a second lift stop to condition the fulcrum in a partial valve lift producing position wherein the second lift stop may be readily adjusted to meet various valve lift requirements.

Another object is to provide a valve lift adjusting device of simple structure requiring no special structural modifications to meet various valve lift requirements.

These and other objects of the present invention will be more apparent from the following description and drawing in which.

Figure 1:
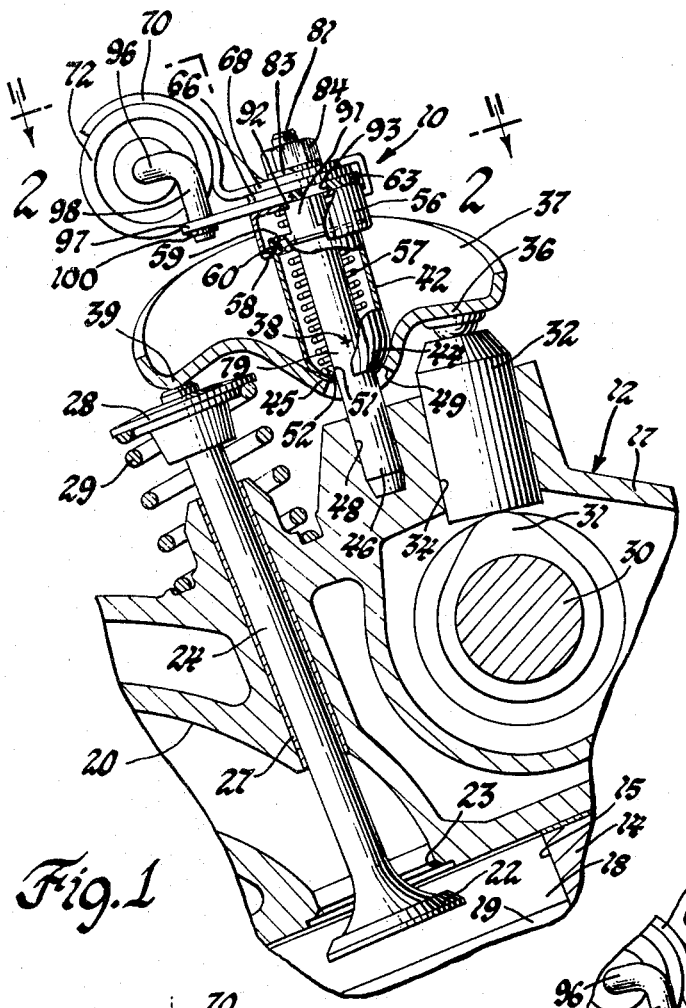
FIG. 1 is a partial view of a naturally aspirated spark ignition internal combustion engine having a valve lift adjusting device according to the present invention incorporated therein with some parts shown in section and some parts shown in elevation and with the valve lift adjusting device shown in its full-lift condition.

Referring to FIG. 1, there is shown a valve lift adjusting device 10 according to the present invention in use in a naturally aspirated spark ignition internal combustion engine 12 of which only those parts are shown which are believed helpful to understanding the invention. The engine includes a cylinder block 14 having one or more cylinders 15 each of which is closed at its upper end by a cylinder head 17 to form a combustion chamber 18 above a reciprocating piston 19 that is disposed in the cylinder. An induction system including a carburetor or other suitable air-fuel mixture device, not shown, supplies fuel to each combustion chamber 18 through an intake port 20 in the cylinder head. Admission of the air-fuel mixture to each combustion chamber 18 is controlled by an intake valve 22 of the poppet type which seats on a valve seat 23 about the intake port 20 in the combustion chamber and has a valve stem 24 extending into the intake port and reciprocably mounted in a valve guide 27 mounted in the cylinder head 17. A valve seat 28 is secured to the projecting upper end of the valve stem 24 and a coil spring 29 which seats at one end on valve seat 28 and at the other end on the cylinder head biases the intake valve 22 to close.

Controlled opening and closing of intake valve 22 to admit delivery of the air-fuel mixture to the respective combustion chamber is provided mechanically by a camshaft 30 which is driven in a conventional manner from the piston driven crankshaft, not shown. The camshaft 30 has a cam lobe 31 for each intake valve which slidably engages the bottom end of a push rod or tappet 32 which is mounted for reciprocation in a bore 34 in the cylinder head. The upper end of the push rod 32 engages one end 36 of a lever or rocker arm 37 which is pivotally supported intermediate its length for rocking movement about an axis 38, as will be described in more detail later, and at its opposite end 39 engages the projecting end of the valve stem 24. Assuming the rocker arm axis 38 is fixed, upward movement of the push rod 32 by cam lobe 31 effects counterclockwise pivoting of the rocker arm 37 about axis 38 and thus opening of the intake valve. At the high point on the cam lobe, the intake valve is fully open as shown in FIG. 1 and thereafter as the camshaft continues to turn, spring 29 then acts to return the intake valve to its closed position and acting through the valve stem effect clockwise pivoting of the rocker arm to maintain the push rod against the cam lobe so that the intake valve has a closing event which is also dictated by the cam profile. The engine also has an exhaust valve arrangement, not shown, for each combustion chamber which is operated from the camshaft to exhaust the products of combustion. The exhaust valve arrangement may be either a conventional type having a rocker arm with a fixed pivot axis in which case normal exhaust valve operation is provided throughout engine operation or may be like the intake valve arrangement herein disclosed to provide, for example, even greater valve overlap where such is desired.

Figure 2:
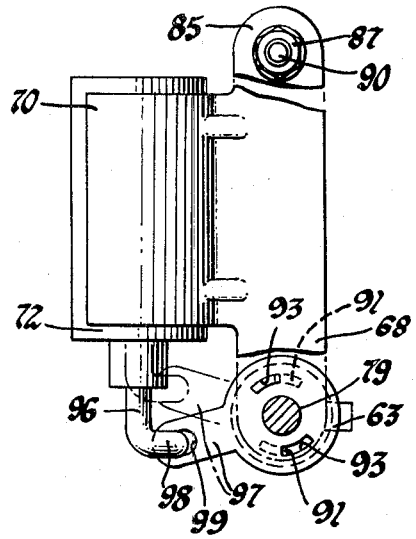
FIG. 2 is a view taken along the line 2-2 of FIG. 1.
Figure 4:
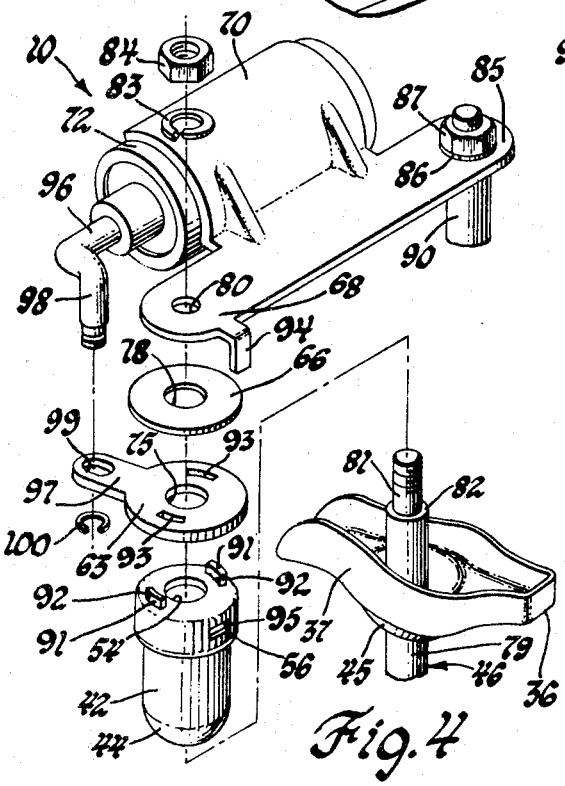
FIG. 4 is an exploded view of the parts of the valve lift adjusting device in FIG. 1.
Figure 3:
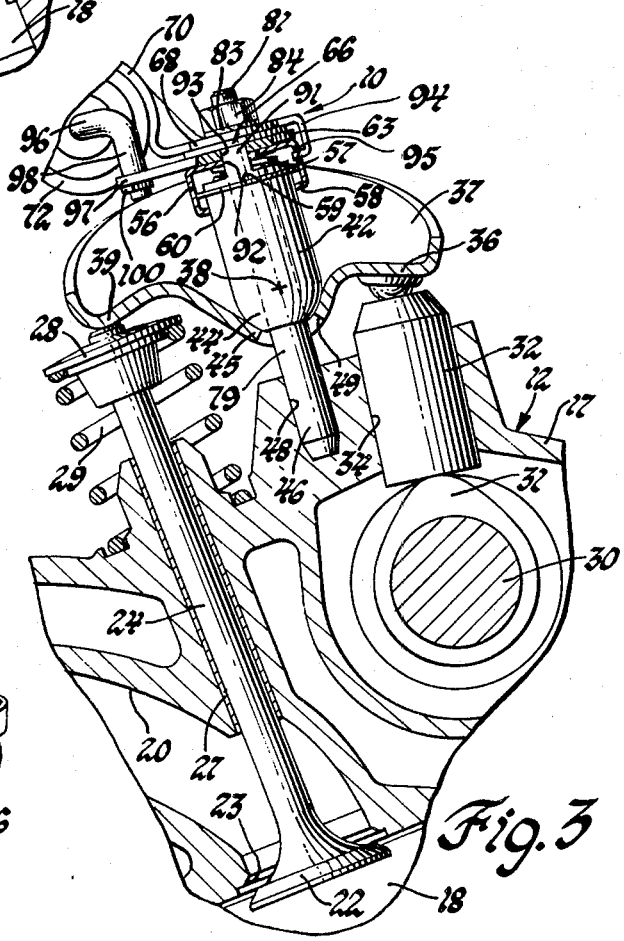
FIG. 3 is a view similar to FIG. 1 but showing the valve lift adjusting device in its partial-lift condition.

The valve lift adjusting device 10 according to the present invention is selectively operable to position the rocker arm pivot axis 38 in the full-lift position shown in FIG. 1 and to adjust this pivot axis to an elevated partial-lift position shown in FIG. 3 providing partial or reduced intake valve lift. As best shown in FIGS. 1, 2 and 4, the valve lift adjusting device comprises a hollow cylindrical fulcrum body 42 having a semi-spherical or bellshaped bottom end 44 which mates with a semi-spherical or socket shaped portion 45 of the rocker arm 37 to establish the rocker arm's pivot axis 38. The fulcrum body 42 is mounted for sliding movement on a post or stud 46 which is press-fitted in a blind bore 48 in the cylinder head 17 and extends upward through an opening 49 in the socket portion 45 of the rocker arm and an aligned opening 51 in the fulcrum portion 44 of the fulcrum body, the fulcrum body having an upwardly extending annular flange 52 about its opening 51 to guide such sliding movement. The stud 46 further extends upward through the fulcrum body 42 and through a central opening 54 in a cap 56 which is received over the open end of the fulcrum body. A coil spring 57 having a spring force substantially less than that of the valve's return spring 29 is arranged in the fulcrum body 42 about the stud 46 and seats at its upper end on the cap 56 and at its lower end on the fulcrum body's fulcrum portion 44 to urge the cap and fulcrum body apart. The cap 56 and the fulcrum body 42 with the spring inside are retained together by the cap 56 having an annular flange 58 which extends radially inwardly toward the fulcrum body. The fulcrum body 42 has adjacent its upper end a radially inwardly extending annular groove 59 in which a split expandable retaining ring 60 is located. The retaining ring 60 is contractable in the groove to permit assembly of the cap and fulcrum body with the spring in place whereafter the retaining ring on clearing the flange 58 expands radially outward so as to be engageable with the cap flange to retain the cap and fulcrum body together against the spring bias and also permit upward movement of the fulcrum body relative to the cap to adjust valve lift as will be described in more detail later.

Sandwiched atop the cap 56 is a selector member 63, a blocker or stop plate 66 and one arm 68 of a bracket 70 to which a solenoid 72 is fixed to operate the valve lift adjusting device. The selector member 63 and stop plate 66 have the same size circular opening or hole 75 and 78, respectively, by which they are received and located on a smooth cylindrical portion 79 of the stud while the bracket arm 68 has a smaller diameter hole 80 by which it is received on a reduced diameter portion 81 of the stud and abuts with a shoulder 82. A lock washer 83 is received over the threaded end of the stud 46 and a nut 84 threaded on the stud secures the bracket arm 68 against the stud shoulder. The bracket arm in turn holds the stop plate 66, selector member 63 and the cap 56 against upward movement.

The solenoid bracket 70 is further secured to the cylinder head to prevent twisting thereof by having another arm 85 that is fastened by a lock washer 86 and nut 87 to a stud 90 which is fixed to the cylinder head and may be the exhaust valve's mounting stud or the arm may be bolted to the head. With the valve lift adjusting device thus assembled on the cylinder head, the selector member 63 is free to pivot in either direction about the stud axis to effect adjustment of valve lift as will now be described.

Axial positioning of the fulcrum body 42 along the stud 46 determines the full and partial valve lift desired and is provided by a pair of lift determining projections 91 which project upwardly from the upper end of the fulcrum body 42 at diametrically opposite locations. The lift determining projections 91 extend upward through openings 92 in the cap 56 and are engageable with the selector member 63 to determine the full-lift position and, alternatively, with the stop plate 66 to determine the partial or reduced lift position. These different engagements are selected by the selector member 63 which has windows or openings 93 therein which are alignable with the projections 91 on pivoting of the selector member to permit the projections to project therethrough past the selector member to engage the stop plate 66. For example, when the selector member 63 is in the position shown in FIG. 1 which is the solid line position shown in FIG. 2 and will be referred to as its full-lift position, the projections 91 engage the bottom side of the selector member 63 to thereby retain full extension of the fulcrum body 42 relative to the cap 56 with little or no clearance between the retaining ring 60 and the cap flange 58. In this condition little or no relative movement is thus permitted between the cap 56 and the fulcrum body 42 and the rocker arm's fulcrum 44 is thus positively maintained in its full-lift position shown in FIG. 1 to effect full or maximum lift of the intake valve 22 by operation of the camshaft 30 through the rocker arm 37. Alternatively, when the selector member 63 is pivoted to the position shown in FIG. 3 and which is shown in phantom line in FIG. 2 and will be referred to as its partial-lift position, its windows 93 are aligned with the projections 91 to permit their passage therethrough and abutment with the bottom side of the stop plate 66 against the bias of spring 57. For such selective engagement, the cap 56 and fulcrum body 42 must be prevented from turning on the stud 46 while the fulcrum body is permitted its sliding movement and this is accomplished by a tang 94 which is formed on the bracket arm 68 and extends past the stop plate 66 and selector plate 63 and has a bent end in a slot 95 in the cap. The projections 91 always engage the fulcrum body 42 in the openings 92, and thus the fulcrum body is prevented from turning by the cap 56 and the tang 94 while remaining free to slide on the stud 46.

With the selector member 63 in its partial-lift position, initial upward movement of the push rod 32 causes the rocker arm 37 to pivot at its valve end 39 counterclockwise about the end of the valve stem 24 while the valve spring 29 holds the intake valve closed and the adjuster spring 57 yields to allow upward movement of the fulcrum body 42 until its projections 91 passing through the selector plate openings 93 engage the stop plate 66. Thereafter, continuing upward movement of the push rod forces the rocker arm to then pivot counterclockwise about its thus elevated pivot axis 38 since the fulcrum body is then positively prevented from further upward movement. As shown in FIG. 3, the intake valve is thus caused to open but to a lesser extent than the full-lift operation previously described because of the initial lost motion and the thus shortened effective valve opening or working movement of the push rod caused by the allowed limited movement of the rocker arm's fulcrum in the direction of the push rod's valve opening stroke. After the high point on the cam lobe is passed, the valve return spring 29 then acts to return the intake valve to its closed position and acting through the valve stem and rocker arm holds the fulcrum body in its partial-lift position. The rocker arm is thus caused to pivot clockwise about its pivot axis 38 and holds the push rod against the cam lobe until the intake valve closes so that the intake valve closing event remains dictated by the cam profile, but occurs earlier than that during the full valve lift operation previously described because of the shortened movement of the push rod necessary to permit valve closure. When the intake valve closes, the adjuster spring 57 then takes over to force the rocker arm to then pivot about the end of the valve stem, and thus continue to hold the push rod against the cam lobe while the fulcrum body is returned to its full-lift position in readiness for a repeat of the above-described events to produce late intake valve opening, partial-intake valve lift and early intake valve closing.

Pivoting of the selector member 63 between its full-lift and partial-lift positions to provide either full or partial valve lift during engine operation is effected by the solenoid 72 which is linked by a rod 96 to a lever arm 97 projecting from the selector member. The rod 96 has a bent end 98 received in a slot 99 in the lever arm and is retained thereto by a snap ring 100 in a groove on the projecting end of the bent end. The solenoid 72 is operable when de-energized to hold the selector member 63 in whatever of its lift selector positions is desired and then, upon energization, is operable to move the selector member and hold it in its other position. The solenoid may be operated by manual or automatic switching. For example, with automatic switching controlled by engine speed, the solenoid may be automatically de-energized below a certain engine speed to provide partial valve lift at low engine speeds and energized above this set engine speed to provide full valve lift at high engine speeds. It will also be understood that the selector member may be controlled manually by the engine operator through suitable mechanical linkage.

Furthermore, the present device is very versatile in that it is capable of providing a range of partial valve lifts without requiring manufacturing modifications. For example, the thickness of the selector plate 63 determines the partial lift effected which may, for example, be one-half of full valve lift. Thus, the device can be designed with a selector plate having a thickness determined to provide the largest partial valve lift expected and less partial valve lift can then be provided in a particular engine application requiring less partial valve lift by simply (1) substituting a selector plate having a smaller thickness to thus move the stop plate closer to the fulcrum body, and (2) substituting a stop plate having a corresponding increased thickness to retain the bottom side of the selector member in its original position.

It will also be understood that while the valve lift adjusting device has been described in use to adjust the lift of an intake valve in an internal combustion engine, it will be understood that the device may also be used to adjust the lift of any other like lever-operated valve where such operation would be of benefit.

The above-described embodiments are illustrative of the invention which may be modified within the scope of the appended claims.

The embodiments of the invention in which an exclusive property or privilege is claimed are defined as follows:

1. In a valve arrangement having a poppet valve biased to close by a spring and forced to open against the spring by a lever, a valve lift adjusting device for selectively establishing full valve lift and partial valve lift comprising fixed support means, fulcrum means providing a fulcrum for the lever slidable along said support means between a full-lift position where movement of the lever effects full valve lift and a partial-lift position where the valve opening movement of the lever is reduced to thereby effect a predetermined partial valve lift, means for preventing turning of said fulcrum means while permitting its sliding movement, stop means supported in a fixed position on said support means, said fulcrum means having projecting lift determining means for engaging said stop means to stop said fulcrum means in said partial-lift position, spring means for yieldingly resisting movement of said fulcrum means to its partial-lift position during valve opening and urging return of said fulcrum means to its full-lift position during valve closing, and selector means supported in a fixed position on said support means intermediate said fulcrum means and said stop means for selective movement to a full-lift selector position for engagement by said projecting lift determining means to stop said fulcrum means in its full-lift position and movement to a partial-lift selector position permitting said projecting lift determing means to project therepast to engage said stop means to stop said fulcrum means in its partial-lift position during valve opening.

2. In a valve arrangement having a poppet valve biased to close by a spring and forced to open against the spring by a lever, a valve lift adjusting device for selectively establishing full valve lift and partial valve lift comprising fixed support means, fulcrum means providing a fulcrum for the lever slidable along said support means between a full-lift position where movement of the lever effects full valve lift and a partial-lift position where the valve opening movement of the lever is reduced to thereby effect a predetermined partial valve lift, means for preventing turning of said fulcrum means while permitting its sliding movement, a stop plate supported by said support means, said fulcrum means having projecting lift determining means for engaging said stop plate to stop said fulcrum means in said partial-lift position, spring means for yieldingly resisting movement of said fulcrum means to its partial-lift position during valve opening and urging return of said fulcrum means to its full-lift position during valve closing, a selector plate having an aperture, and said selector plate supported by said support means intermediate said fulcrum means and said stop plate for selective movement to a partial-lift selector position aligning said aperture with said projecting lift determining means to permit said projecting lift determining means to project through said selector plate to engage said stop plate to stop said fulcrum means in its partial-lift position during valve opening and movement to a full-lift selector position for engagement by said projecting lift determining means to stop said fulcrum means in its full-lift position.

* * * * *